US006939042B2

(12) United States Patent
Rusnak et al.

(10) Patent No.: US 6,939,042 B2
(45) Date of Patent: Sep. 6, 2005

(54) BAG WITH ELASTIC STRIP AND METHOD OF MAKING THE SAME

(75) Inventors: John Rusnak, Willowbrook, IL (US); Jeff Shoemaker, Oakland, CA (US); Amit Shah, Willowbrook, IL (US); Scott O'Hara, Willowbrook, IL (US)

(73) Assignee: The Glad Products Company, Oakland, CA (US)

( * ) Notice: Subject to any disclaimer, the term of this patent is extended or adjusted under 35 U.S.C. 154(b) by 83 days.

(21) Appl. No.: 10/402,719

(22) Filed: Mar. 28, 2003

(65) Prior Publication Data

US 2004/0202388 A1 Oct. 14, 2004

(51) Int. Cl.[7] ..... B65D 33/16

(52) U.S. Cl. ..... 383/71; 383/33; 383/37; 383/75; 383/77; 383/120; 220/495.11

(58) Field of Search ..... 383/71, 75, 77, 383/33, 43, 8, 37, 120; 220/495.11

(56) References Cited

U.S. PATENT DOCUMENTS

| | | | | |
|---|---|---|---|---|
| 1,338,375 | A | | 4/1920 | Kleidman |
| 1,479,135 | A | | 1/1924 | Guinzburg |
| 2,585,214 | A | | 2/1952 | Belmont |
| 2,737,701 | A | | 3/1956 | Dereniuk et al. |
| 3,079,844 | A | | 3/1963 | Kugler |
| 3,819,401 | A | | 6/1974 | Massengale et al. |
| 3,912,565 | A | | 10/1975 | Koch et al. |
| 3,979,050 | A | | 9/1976 | Cilia |
| 4,292,033 | A | | 9/1981 | Wolske |
| 4,338,979 | A | | 7/1982 | Dow |
| 4,355,494 | A | | 10/1982 | Tilman |
| 4,515,595 | A | | 5/1985 | Kievit et al. |
| 4,543,099 | A | | 9/1985 | Bunnelle et al. |
| 4,640,859 | A | | 2/1987 | Hansen et al. |
| 4,675,016 | A | | 6/1987 | Meuli et al. |
| 4,747,701 | A | * | 5/1988 | Perkins ..... 383/33 |
| 4,812,074 | A | | 3/1989 | Ausnit et al. |
| 4,859,082 | A | | 8/1989 | Llorens |
| 4,882,794 | A | * | 11/1989 | Stewart, III ..... 4/451 |
| 4,906,108 | A | | 3/1990 | Herrington et al. |
| 4,908,247 | A | | 3/1990 | Baird et al. |
| 4,953,704 | A | | 9/1990 | Cortese |
| 4,989,994 | A | | 2/1991 | Gelbard |
| 5,120,138 | A | | 6/1992 | Midgley et al. |
| 5,133,607 | A | | 7/1992 | Bonke |
| 5,404,999 | A | * | 4/1995 | Bednar ..... 206/204 |
| 5,524,990 | A | | 6/1996 | Buck |
| 5,720,557 | A | * | 2/1998 | Simonsen ..... 383/61.2 |
| 6,022,144 | A | | 2/2000 | Hausslein |
| 6,059,458 | A | | 5/2000 | Belias et al. |
| 6,164,824 | A | * | 12/2000 | McGlew et al. ..... 383/75 |
| 6,220,753 | B1 | | 4/2001 | Metzger |
| 6,585,415 | B2 | * | 7/2003 | Malaspina ..... 383/75 |

FOREIGN PATENT DOCUMENTS

| | | |
|---|---|---|
| WO | 00/39005 | 7/2000 |
| WO | 03/39005 | 7/2000 |

* cited by examiner

*Primary Examiner*—Jes F. Pascua
(74) *Attorney, Agent, or Firm*—Thomas C. Feix

(57) ABSTRACT

Provided is a plastic bag including a live elastic strip that, in the elastic strip's normal condition, contracts thereby constricting an opening of the bag to assist in retaining the bag to an object. The elastic strip includes a first region that is continuously attached to a sidewall of the bag between a first side edge and a second side edge of the bag and a second region that remains unattached to the sidewall. The attached region does not contract but instead forces the portion of the sidewall to which it is attached to pucker into a serpentine path. The unattached region does contract causing the portion of the sidewall to which it is adjacent to bunch together. Also provided is a method for manufacturing a plastic bag that involves stretching a live elastic tape and continuously attaching a region of the stretched tape to a web of plastic material.

13 Claims, 14 Drawing Sheets

BAG WITH ELASTIC STRIP AND METHOD OF MAKING THE SAME

FIELD OF THE INVENTION

The present invention is related in general to plastic sheet material and to a method of producing the same, and more particularly to plastic sheet material in the form of a bag including a strip of live elastic material and a method of making the same. The invention has particular utility in the high-speed continuous production of elasticized plastic liner bags for trashcans, for example, wherein the elastic properties enable the liner bag to be secured in place within the trashcan.

BACKGROUND OF THE INVENTION

Plastic trash bags are produced and sold on an extensive scale in a variety of shapes and sizes. The vast majority of these bags are made of polyethylene film. The bags in general include sidewalls that are often joined by one or more seams, a closed lower bottom end, and an open top end. The trash bag can serve as a liner for a trashcan. Conventionally, an upper edge of the bag, which defines the opening, is rolled over an upper lip of the trashcan to position the bag in an open position and to secure the bag to the trashcan. It can be difficult to maintain the bag in the open position and in a secured relationship with respect to the top of the trashcan when the bag is loaded with trash.

The use of elastic means for securing the open end of a liner bag to the top edge of a trashcan is generally known. It is desirable for such an elastic top bag to provide adequate "grip" to the trashcan to prevent the bag from falling into the trashcan when loaded with trash. One problem encountered with producing such trash bags involves the interaction between the elastic material and the film substrate of the bag. For instance, the elastic material must be able to stretch and contract to provide the desired "grip" but the film substrate is typically inelastic.

An attachment method used in the incontinence industry involves the intermittent bonding or "stitch attachment" of elastic material onto a substrate such that between every two bond regions there is a discernable unattached length of the heat activated elastic film material. This type of basic pattern can be repeated to make spaced intervals or "stitches" of attached and unattached sections. Once the garment has been processed, the unattached portions of the elastic material shrink to provide a shirred and elastic garment. This attachment method can also be applied to making elastic top trash bags, such as shown in U.S. Pat. No. 5,120,138 to Midgley and International PCT Patent Application No. WO 00/39005 to Marchal There is a need in the art for an improved method of continuous production of elasticized liner bags which is cost effective.

BRIEF SUMMARY OF THE INVENTION

The present invention provides a low cost bag having an elastic strip extending adjacent to an open top end of the bag that can be drawn over and around the periphery of an object such as a trash receptacle to retentively engage the bag and the object. The present invention also provides a method of manufacturing such a bag in a high speed manufacturing process utilizing "live," or elasticized, tape.

In one aspect of the invention, a bag is provided that includes a first sidewall and a second sidewall joined together at a common closed bottom end and along two sealed side edges. At the top of the bag, the top edges of the two sidewalls form a rim that defines an opening through which an interior volume of the bag can be accessed. For retaining the bag to an object, a pre-stretched strip of "live" elastic tape can be attached to at least one sidewall, extending between the first sealed edge and the second sealed edge proximate to the open top end in a tensioned condition. The term "live" means that the material has an elastic quality. When the elastic strip is un-tensioned, or released such that the tape is allowed to contract, the top open end is pulled together, thereby narrowing the opening defined by the rim. Accordingly, to draw the top end around an object, the elastic strip can be stretched to expand the opening.

In another aspect of the invention, to manufacture the above-described bag, a tape of "live" elastic material is pre-stretched under tension to an expanded length. The pre-stretched tape is passed adjacent to a continuously provided sheet of thermoplastic material, referred to as a web, and the two are continuously attached together along a continuous seam. To prevent the elastic tape from contracting after attachment and distorting the web, the web is held under constant tension thereby maintaining the stretched condition of the tape. The tensioned web and attached tape are passed through additional manufacturing processes to produce the finished bag. For distributing the finished bags, the web may be segmented into a plurality of bags via perforations and wound into a roll such that tension is maintained on the elastic strip.

To enable the elastic strip to contract when attached to the bag, only a portion of the elastic strip is attached continuously between the first and second sealed edges of the bag. The unattached portion of the elastic strip can contract when the tension is released from the bag. As the unattached portion contracts, it displaces the sidewalls of the bag, thereby causing the bunching or gathering of the bag and the narrowing of the opened top end. This construction prevents the attached portion from shearing itself off the sidewall or otherwise destroying the bag during contraction of the strip.

Thus, an advantage of the present invention is that it provides a thermoplastic bag with an elastic strip that can be quickly and inexpensively manufactured in a high-speed production setting. A related advantage is that the invention utilizes continuously provided, live elastic tape that simplifies the manufacturing process of the bags. Another advantage is that the invention provides a simple way of preparing a plurality of elasticized bags for packaging and distribution. These and other advantages of the present invention, as well as additional inventive features, will become apparent from the description of the invention provided herein.

DETAILED DESCRIPTION OF THE EMBODIMENTS OF THE INVENTION

Figure 1:
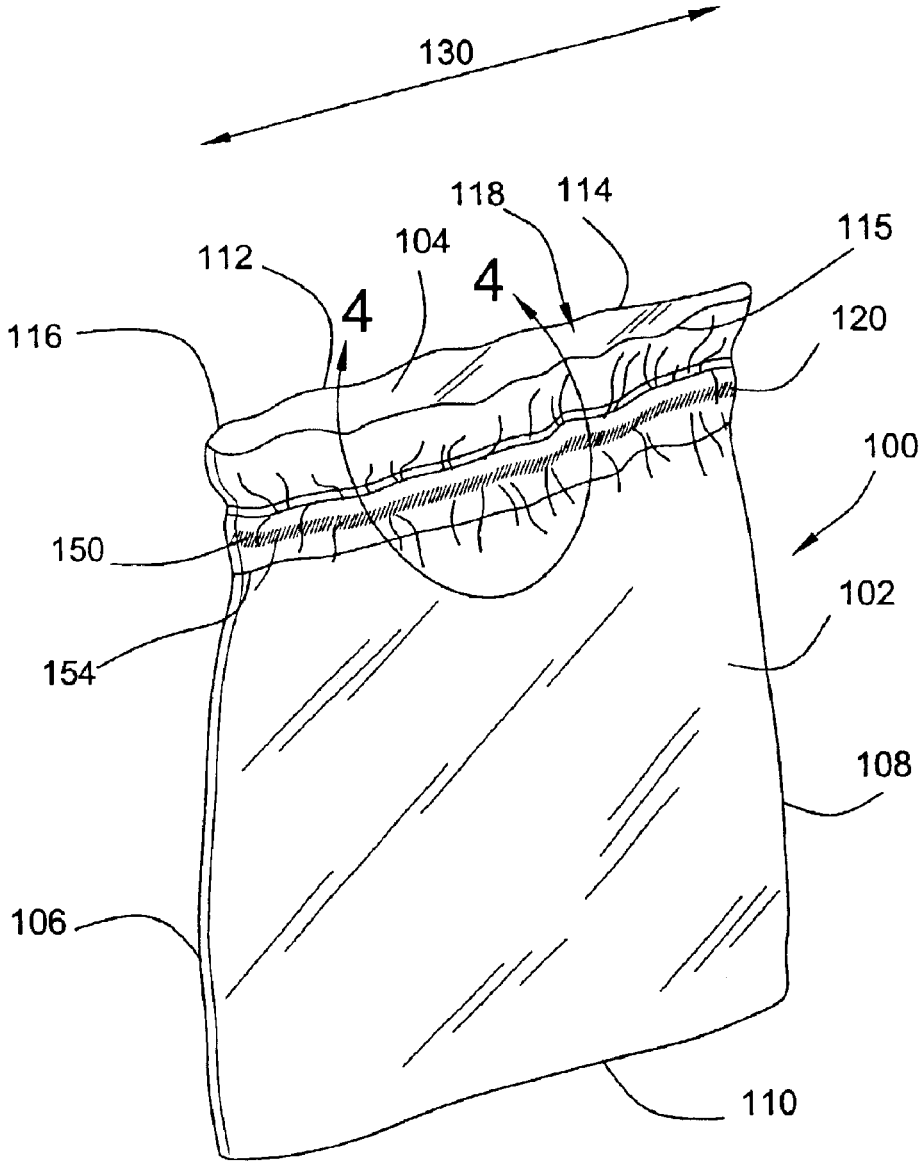
FIG. 1 is a perspective view of a plastic bag having an elastic strip attached thereto.

Turning now to the drawings, wherein like reference numerals refer to like elements, there is shown in FIG. 1 an illustrative bag 100 having a first sidewall 102 and a second sidewall 104 joined along a common closed bottom end 110. The bottom end 110 can be joined by a heat seal or folded in a U-fold or J-fold. The first and second sidewalls 102, 104 are joined along a first sealed edge 106 and a second sealed edge 108 and define an open top end 112. Each sidewall 102, 104 includes a respective top edge 114, 115 with the top edges 114, 115 forming a rim 116 that defines an opening 118 through which an interior volume of the bag 100 can be accessed. The sidewalls can be made from any suitable material, such as a thermoplastic material suitable for the high-speed production of disposer and food storage bags, including, but not limited to, high density polyethylene, low density polyethylene, linear low density polyethylene, and/or a combination thereof.

Located on the bag 100 attached to the first sidewall 102 near the open top end 112 is a strip of elastic material 120 that extends between the first sealed edge 106 and the second sealed edge 108. The elastic strip is parallel with an X-axis 130 that runs along the width of the bag. The elastic strip 120 can be located approximately one-half to about five inches from the top end 112. Attachment of the elastic strip 120 to the first sidewall can be achieved by adhesive, heat sealing, stitching, or other methods well known in the art. The elastic strip is illustrated in a normal condition where the strip is un-tensioned along the direction of the X-axis 130. Placing the elastic strip in the normal condition causes the first sidewall to bunch together, thereby constricting the opening 118 and causing the bag 100 to assume a shirred appearance.

Figure 2:
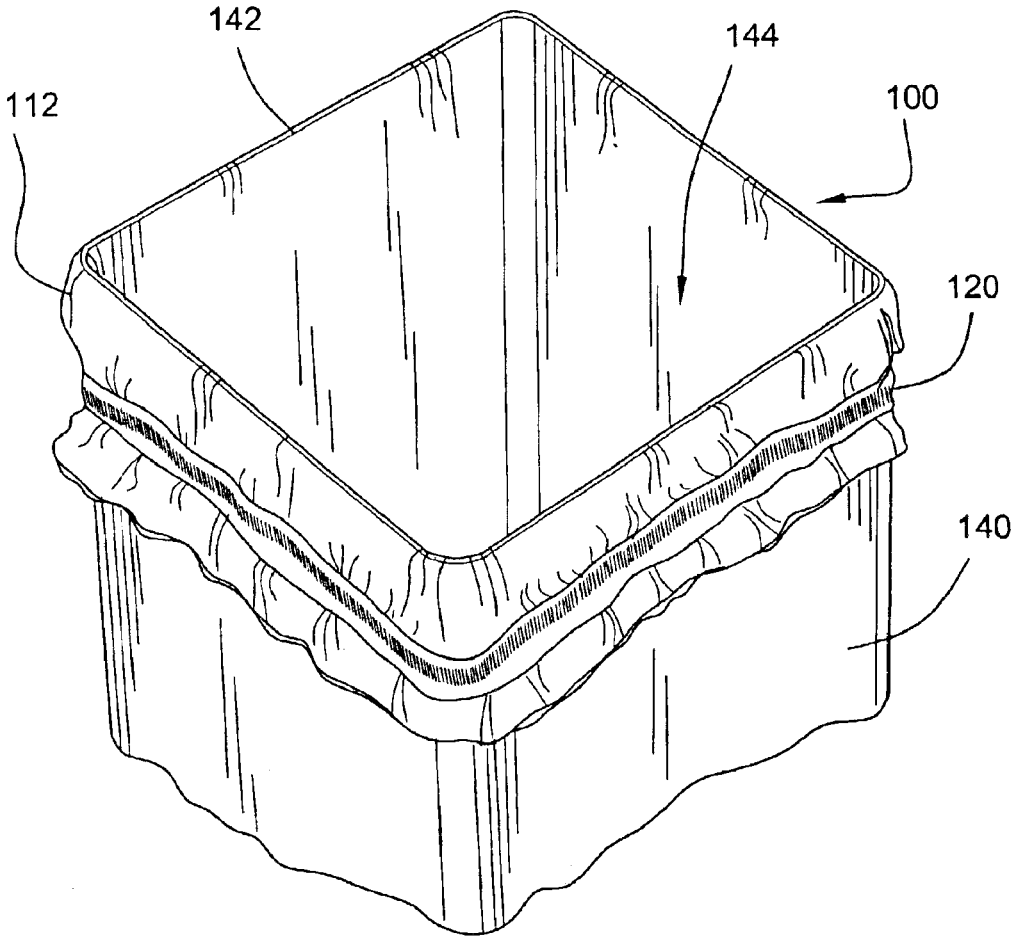
FIG. 2 is a perspective view of the plastic bag of FIG. 1 mounted to a trash can with the elastic strip used to secure the plastic bag to the trash can.
Figure 3:
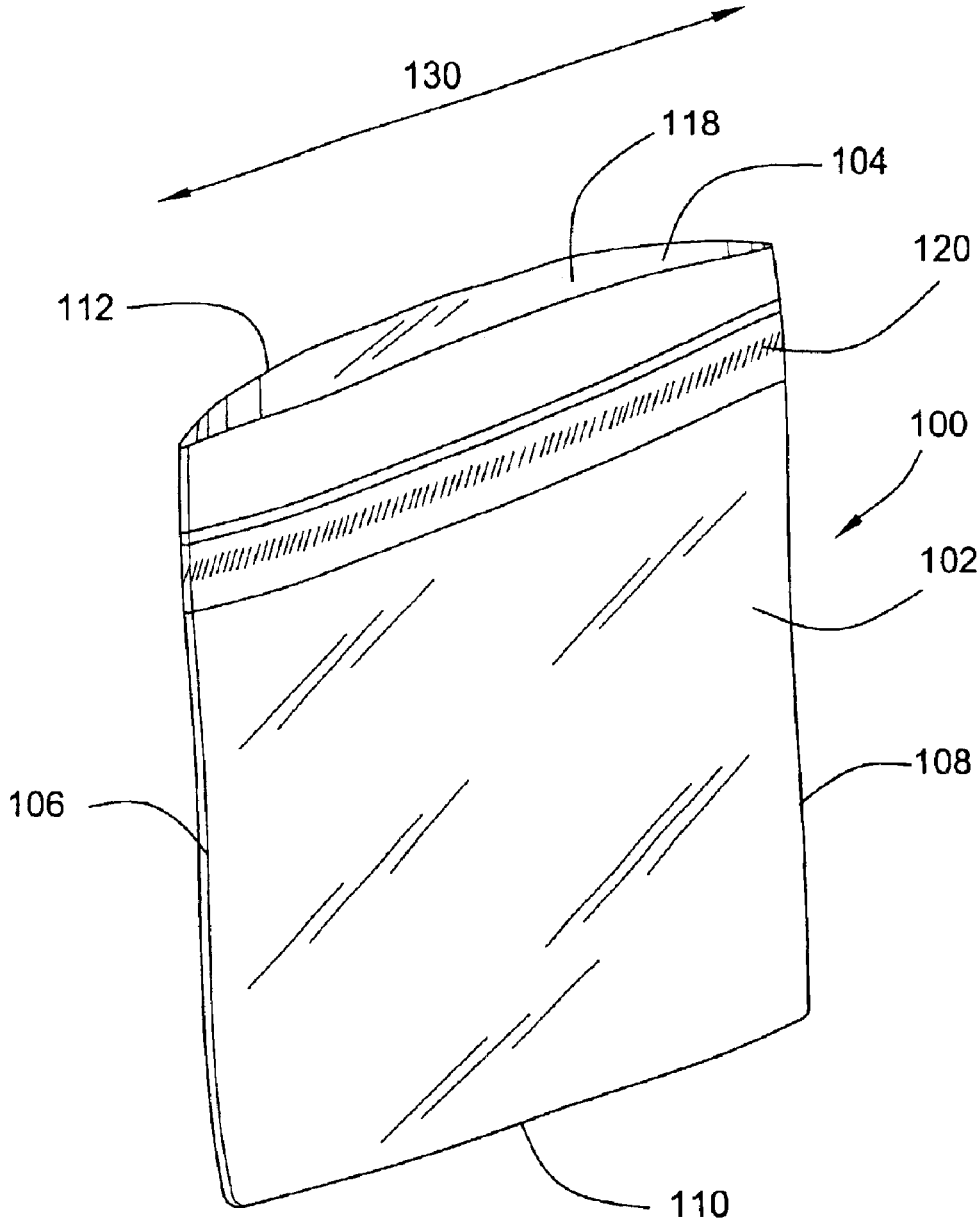
FIG. 3 is a perspective view of the plastic bag of FIG. 1 with the elastic strip stretched under tension.

Referring to FIG. 2, the bag 100 is secured to a trashcan 140. The strip allows for ready access to the interior volume of the bag and provides a gripping force to facilitate mounting the bag to an object, such as a trashcan, in an open position. The bag 100 is shown with the top end 112 wrapped around an upper lip 142 of the trashcan with the remainder of the bag 100 being inserted into a cavity 144 within the trashcan 140. To secure the bag 100 to the trashcan 140, the elastic strip 120 can allow the top end 112 to constrict around the perimeter of the trashcan 140, thereby providing a gripping force. To install the bag 100, the top end 112 can be expanded from the constricted position shown in FIG. 1. Referring to FIG. 3, to widen the opening 114, the elastic strip 120 can be placed in tension along the X-axis 130 which, in turn, can cause the elastic strip to stretch and expand. Stretching the elastic strip 120 can allow the first and second sidewalls 102, 104 to un-bunch.

Figure 4:
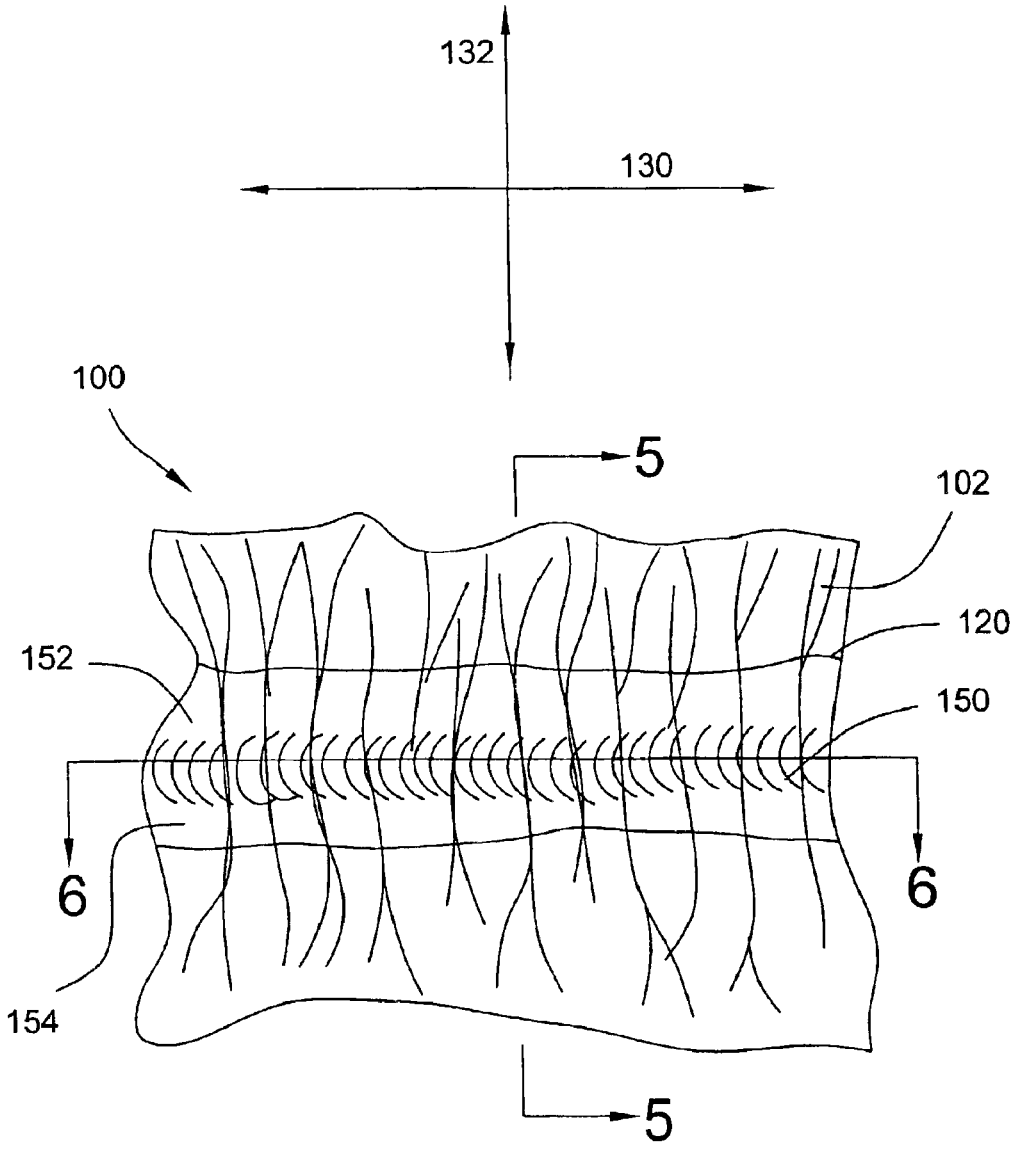
FIG. 4 is an enlarged, detail view of the region indicated by the arrows 4—4 in FIG. 1.
Figure 5:
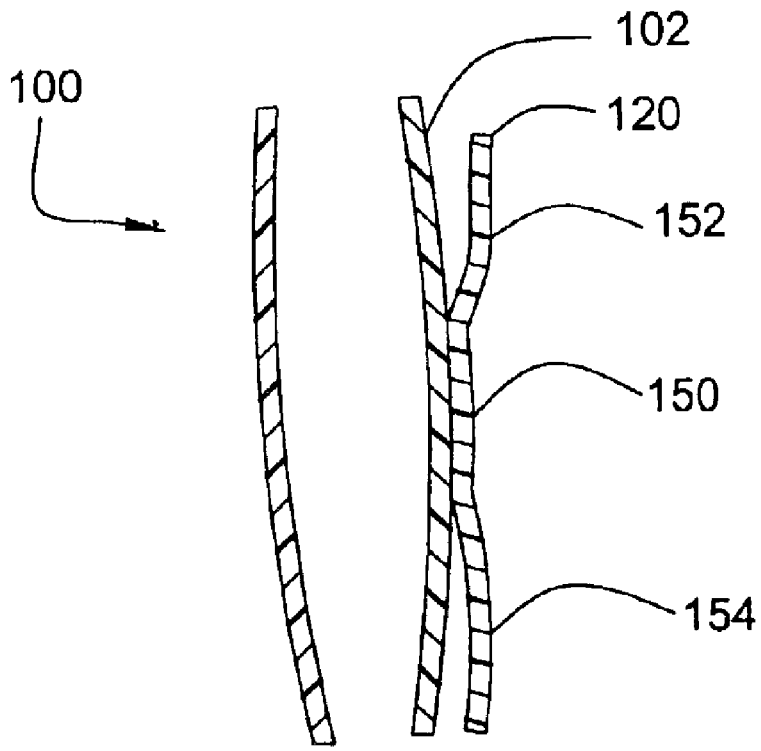
FIG. 5 is a cross-sectional view taken along line 5—5 in FIG. 4.

Referring to FIG. 4, elastic strip 120 is attached to the first sidewall 102. The elastic strip 120 can include an attached region 150 disposed between a pair of unattached edge regions 152, 154. The attached region 150 and the two unattached regions 152, 154 are parallel to each other. As illustrated in FIG. 5, the attached region 150 of the elastic strip 120 is securely fixed adjacent to the first sidewall 102 while the unattached edge regions 152, 154 loosely overlap the first sidewall 102. Referring to FIG. 1, it is seen that the attached region 150 and the two unattached regions 152, 154 extend across the entire width of the bag 100 between the first sealed edge 106 and the second sealed edge 108.

Referring to FIG. 4, the attached region 150 and the unattached regions 152, 154 of the elastic strip 120 are approximately the same height, measured along a Y-axis 132, as each other. The Y-axis 132 is perpendicular to the X-axis 130. For example, the elastic strip 120 may be approximately ¾ of an inch high with the attached region 150 being approximately ¼ of an inch high. The heights of the two unattached regions 152, 154 are each approximately ¾ of an inch.

Preferably, the total surface area of the attached region 150 of the elastic strip 120, i.e., the surface area of the elastic strip that is joined to the first sidewall, is equal to or less than the total surface area of the unattached region of the elastic strip 120, i.e., the first and second unattached regions 152, 154 in this case, according to the following expression: $(A_s/A_u)<1$, where $A_s$ is the surface area of the attached region 150 and $A_u$ is the combined surface area of the unattached regions 152, 154. The relationship expressed above can apply to an elastic strip with a height between about one-half inch to about one and one-half inch, for example. In other embodiments, the relationship between the surface area of the attached region and the surface area of the unattached region can be varied.

Figure 6:
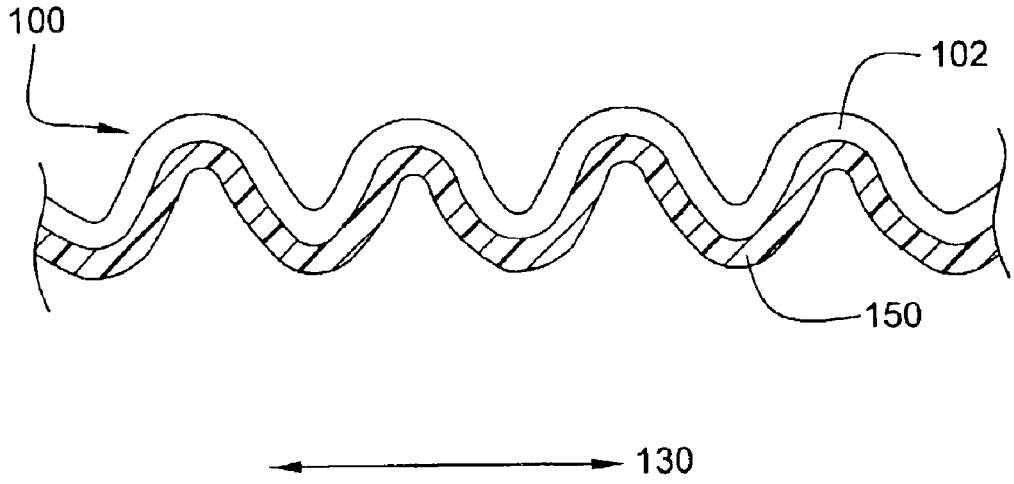
FIG. 6 is a cross-sectional view taken along line 6—6 in FIG. 4.

Referring to FIG. 4, when the tension causing the elastic strip 120 to stretch is released, the two unattached regions 152, 154 of the elastic strip contract causing the sidewall 102 to bunch together. The attached region 150, which is fixedly joined to the sidewall 102, does not substantially contract. Instead, as illustrated in FIG. 6, to accommodate the contracted unattached regions and bunching sidewall, the attached region 150 of the elastic strip and the sidewall 102 pucker into a serpentine path.

In other embodiments, the elastic strip can include an attached region and a single unattached region. In other embodiments, the number of attached regions and/or unattached regions can be varied.

Figure 7:
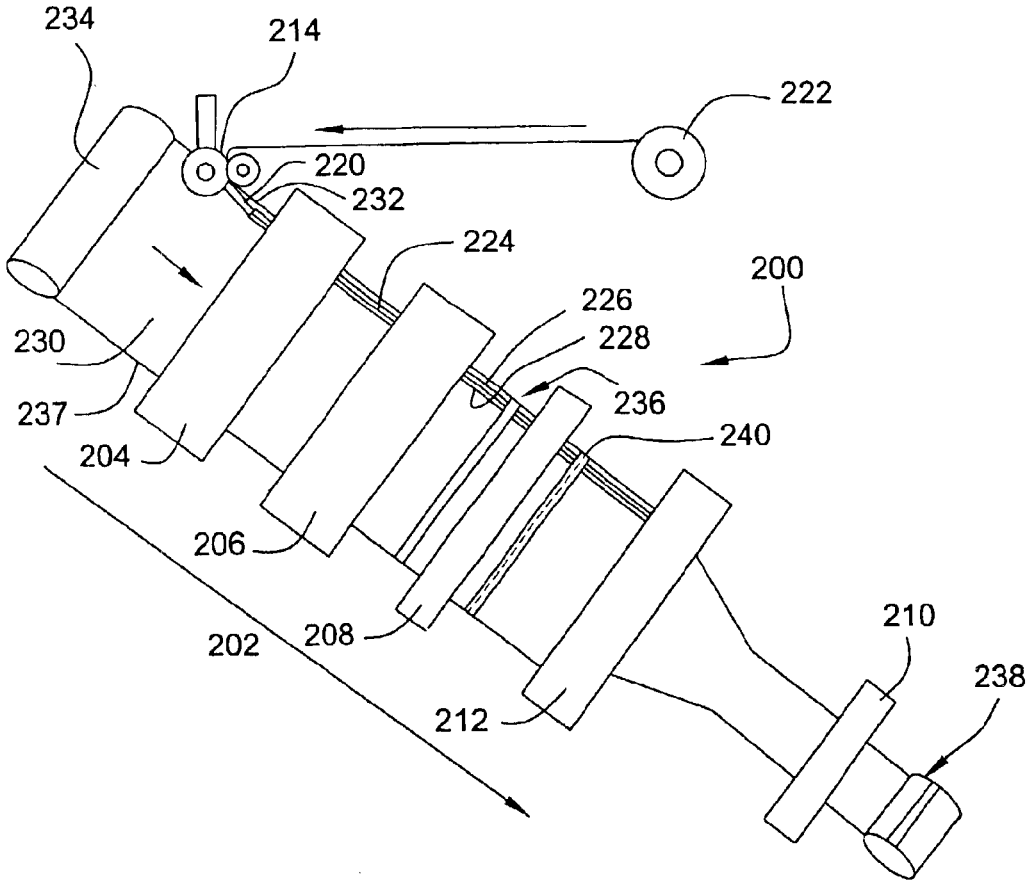
FIG. 7 is a generally schematic view illustrating a method for producing a bag using a continuous web of plastic and a live elastic tape.

Referring to FIG. 7, there is illustrated an embodiment of a manufacturing process for producing the above-described bag. The manufacturing process is carried out by automated machinery 200 operating continuously at high speeds.

The elastic material is initially provided as a tape 220 wound onto a roll 222. The tape has a continuous length and a predefined width defined by two side edges 226, 228. The tape 220 is unwound and aligned in a machine direction 202 overlaying a continuously advancing web of thermoplastic material 230, such as high density polyethylene, adjacent to a top edge 232.

The web 230 may be provided from a roll 234 of web material that is continuously unwound and advanced through the machine 200 along the machine direction 202. To provide the first and second sidewalls, the web may be folded in half along the machine direction 202 to produce two layers passing through the machine. In other embodiments, a second web of thermoplastic material can be advanced through the machine adjacent to and overlapped by the first web 230.

The tape 220 can be stretched from its normal condition before being attached to the web. To stretch the tape 220, nip rolls 214 can be provided which draw tape at a faster rate than the tape is unwound from the roll 222. Preferably, a stretch of between about 30% and about 50% is introduced to the tape prior to the tape being attached to the web. In another embodiment, the tape 220 can be stretched after having passed through the nip rolls 214 but prior to being attached to the web 230.

A discrete region 224 along the width of the elastic tape 220 is continuously attached to the web by an attachment device 204. The tape attachment device can attach the elastic tape 220 by heat sealing, adhesive bonding, stitching, or other attachment method commonly known in the art. After the tape 220 has been attached to the web 230, the tension on the tape 230 can be maintained by holding the web 230 taut along the machine direction 202 as it advances through the machine 200.

In an embodiment, a second tape can be unwound from a second roll, aligned in the machine direction overlaying the web, and attached thereto. For instance, the second tape can be attached on a surface of the web opposite the surface to which the first tape is attached. In the embodiments in which the web has been folded or multiple webs are provided to create first and second sidewalls, the second tape can be attached to the second sidewall.

As the web 230 and the tape 220 advance in the machine direction 202, a bag seal device 206 forms a plurality of side seals 236 in the web 230 perpendicular to the machine direction 202. Adjacent side seals 236 are in predetermined, spaced relationship to each other. Preferably, the side seals are approximately a ¼ of an inch in width and extend completely across the web between the top edge 232 and a bottom end 237.

A perforation operation can be performed on the web 230 by a perforation device 208 in the form of a knife to form perforations through the side seals 236. Each perforation 240 extends longitudinally along the respective side seal 236. Two adjacent perforations 240 define a bag assembly along the web 230. The web 230 can be torn along each perforation 240 to define a pair of side edges, one side edge on two adjacent bags, and to segment the elastic tape 220. The tear strength of each perforation 240 can be such as to allow the perforation 240 to be torn by hand and to prevent the perforation 240 from tearing as it is advanced through the machine 200.

In one embodiment, the processed web 230 can be continuously wound into a roll 238 by a winder 210. Prior to the winding operation, the web 230 may pass through a V-folder assembly 212 that folds the web 230 into a smaller size.

In the embodiment in which the web 230 is wound into a roll 238, the tension of the web 230 is preferably maintained so that the elastic tape 220 remains in the stretched condition.

The elastic tape when in its normal condition has a given width and thickness. As the tape is stretched under tension during the manufacturing process, the width and thickness can be reduced as the overall length is increased. To produce a bag with an elastic strip of a predetermined width and thickness, un-stretched tape of a larger width and thickness can be initially provided.

Figure 9:
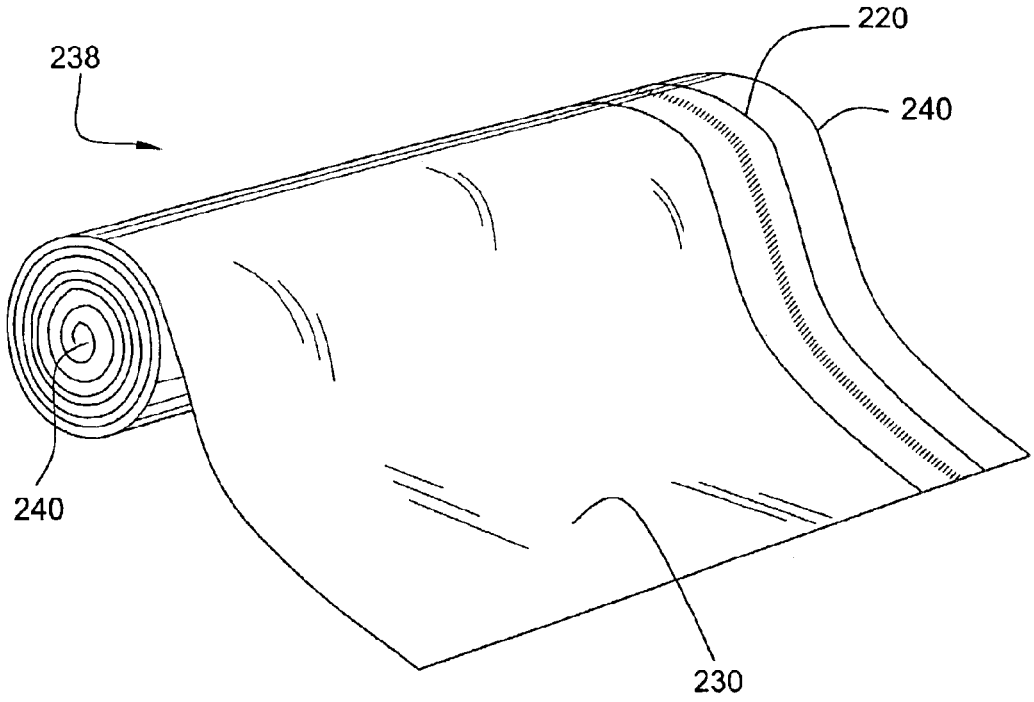
FIG. 9 is a perspective view of a plurality of plastic bags produced by the method illustrated in FIG. 7 wound into a roll.

In the embodiments in which the finished bags are distributed on a roll with the perforations intact, the bags can be tightly wound to prevent the elastic strips from contracting to their normal positions. For example, referring to FIG. 9, the processed web 230 and attached elastic tape are wound around an axis 240 so that successive layers of the web and tape bury and hold the inner layers in the stretched condition. In some embodiments, to facilitate winding, a core may be provided at the winding operation around which the bag can be wound. Once the outermost bag is unwound from the roll 238 and detached along the perforation line, the tension is removed from the bag and the elastic strip contracts to constrict the opening.

The elastic tape 220 can be capable of undergoing rapid stretching while retaining its elasticity. In embodiments in which the bag is distributed with the elastic tape in its stretched condition, the tape can be constructed such that it does not exhibit significant creep over extended periods of time (e.g., on the order of a year or more). The creep resistance of the elastic strip can facilitate the use of the bag in situations which require the elastic to be stretched for significant periods of time. Furthermore, the tape can be constructed such that it withstands being attached to the web by, for example, heat sealing.

Figure 8:
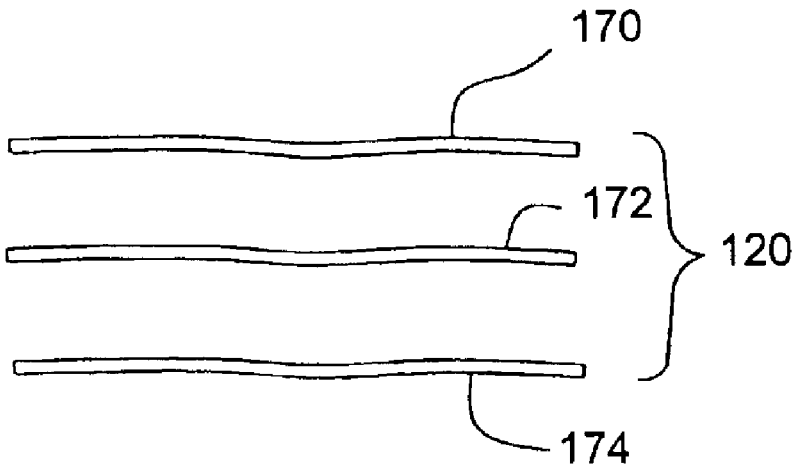
FIG. 8 is an enlarged, exploded view of an elastic tape for use with the present invention.

The live elastic tape can be made from any suitable material, such as, EVA (ethylene-vinyl acetate co-polymer), VLDPE (very low density polyethylene), Lycra® by DuPont, EPDM (ethylene propylene diene monomer rubber), and rubber, for example. In some embodiments, the elastic tape 220 may be provided as a multi-layer structure as illustrated in FIG. 8.

For example, the tape 220 can be made of a core layer 172 disposed between two skin layers 170, 174. The skin layer 170, 174 can facilitate attachment of the tape to the web while the core 172 can provide the desired elastic properties.

Figure 10:
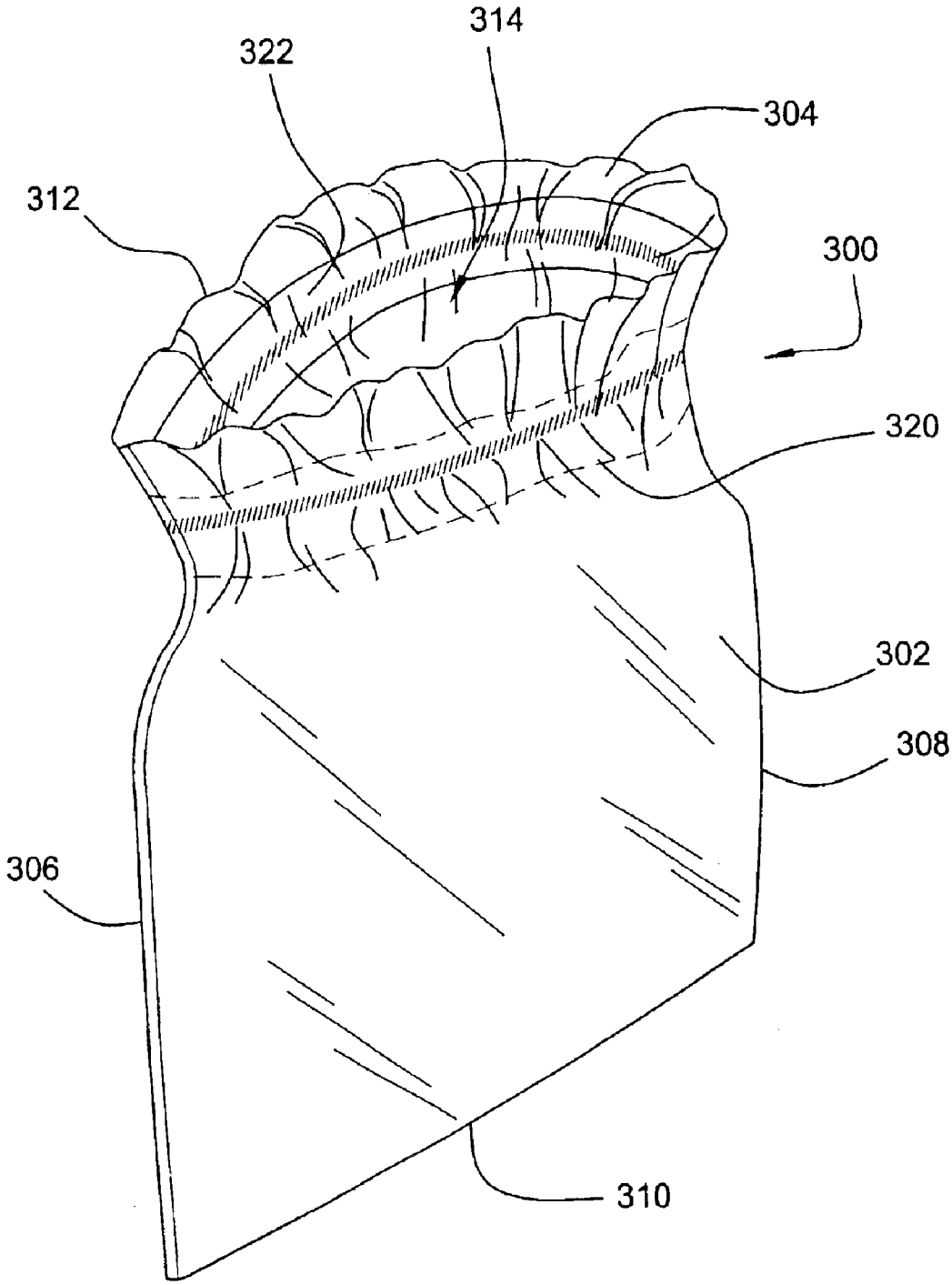
FIG. 10 is a perspective view of another embodiment of the present invention in the form of a plastic bag having two elastic strips mounted thereto.

Referring to FIG. 10, there is shown another embodiment of a bag 300. The bag 300 includes a first sidewall 302 and a second sidewall 304 that are joined at a common bottom end 310, a first sealed edge 306, and a second sealed edge 308. This configuration of the bag 300 thereby defines a top end 312 with an opening 314 through which an interior volume can be accessed. A pair of elastic strips 320, 322 are attached to the insides of the first and second sidewalls 302, 304, respectively, adjacent to the top end 312. Preferably, the elastic strips 320, 322 extend across the sidewalls 302, 304 between the first sealed edge 306 and the second sealed edge 308. As illustrated, when the elastic strips are allowed to contract to their normal position, the attached sidewalls are bunched together thereby constricting the opening to the interior volume and giving the bag a shirred appearance.

Figure 11:
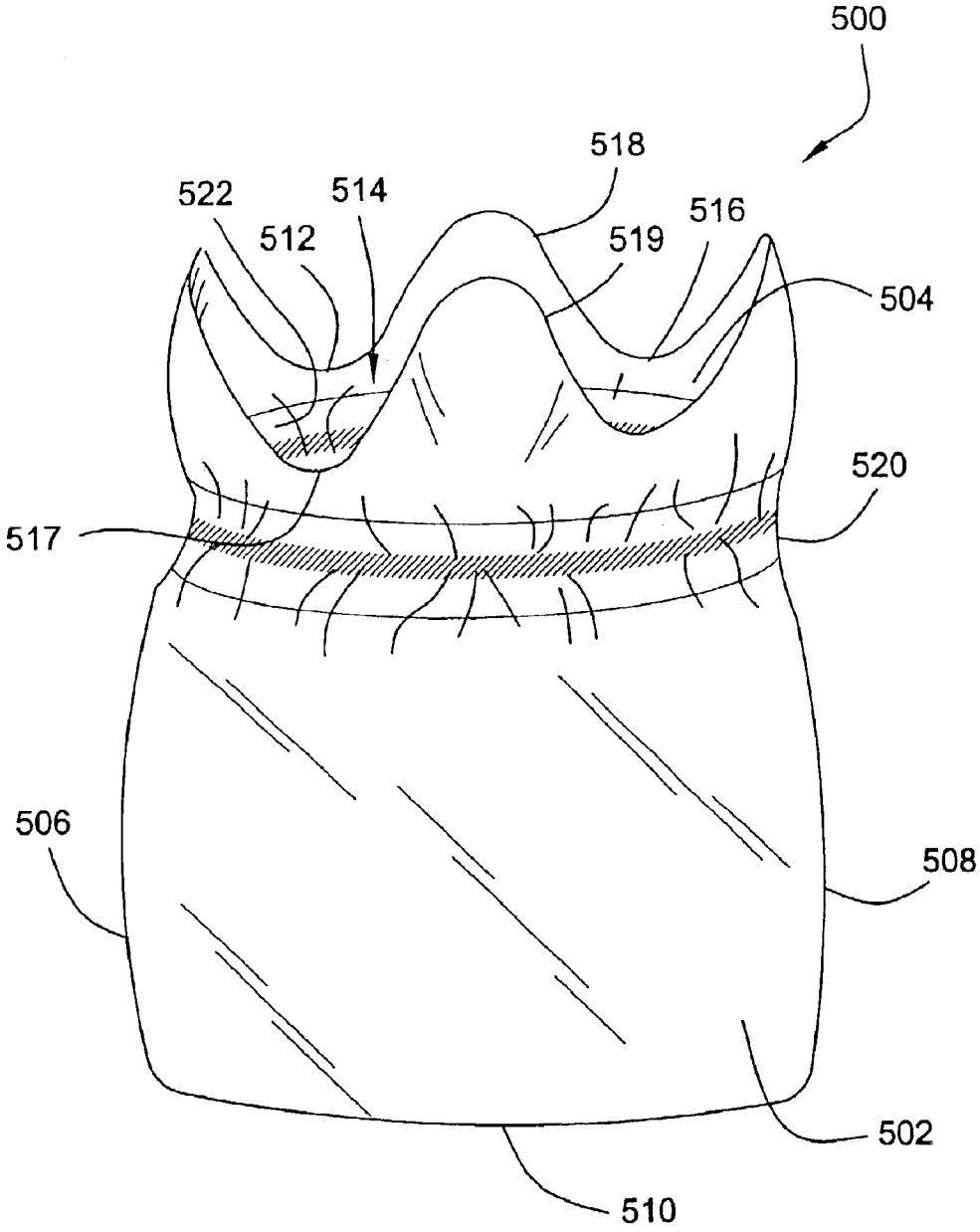
FIG. 11 is a perspective view of another embodiment of the present invention in the form of a tie flap plastic bag having an elastic strip mounted thereto.

Referring to FIG. 11, there is illustrated another embodiment of a bag 500 which has tie-flaps to facilitate removal and disposal. Specifically, the bag 500 includes first and second sidewalls 502, 504 joined by a common bottom end 510, a first sealed edge 506, and a second sealed edge 508. This design of the bag thereby defines a top end 512 having an opening 514 through which an interior volume of the bag can be accessed. Each of the sidewalls 502, 504 includes a flap portion 518, 519 extending from a respective upper edge 516, 517 of the sidewalls 502, 504. The bag 500 can include a strip of elastic material 520 that is adjacent the open top 512 and extends across the first sidewall 502 between the first sealed edge 506 and the second sealed edge 508. A second strip 522 of elastic material can also be included, which extends across the second sidewall 504 between the first sealed edge 506 and the second sealed edge 508. When the elastic strips 520, 522 are in the normal position, as shown in FIG. 1, the bag 500 takes on a shirred appearance. To broaden the opening, the elastic strips 520, 522 can be stretched along their longitudinal axes. To close the opening 514, the flap portions 518, 519 can be knotted together.

Figure 12:
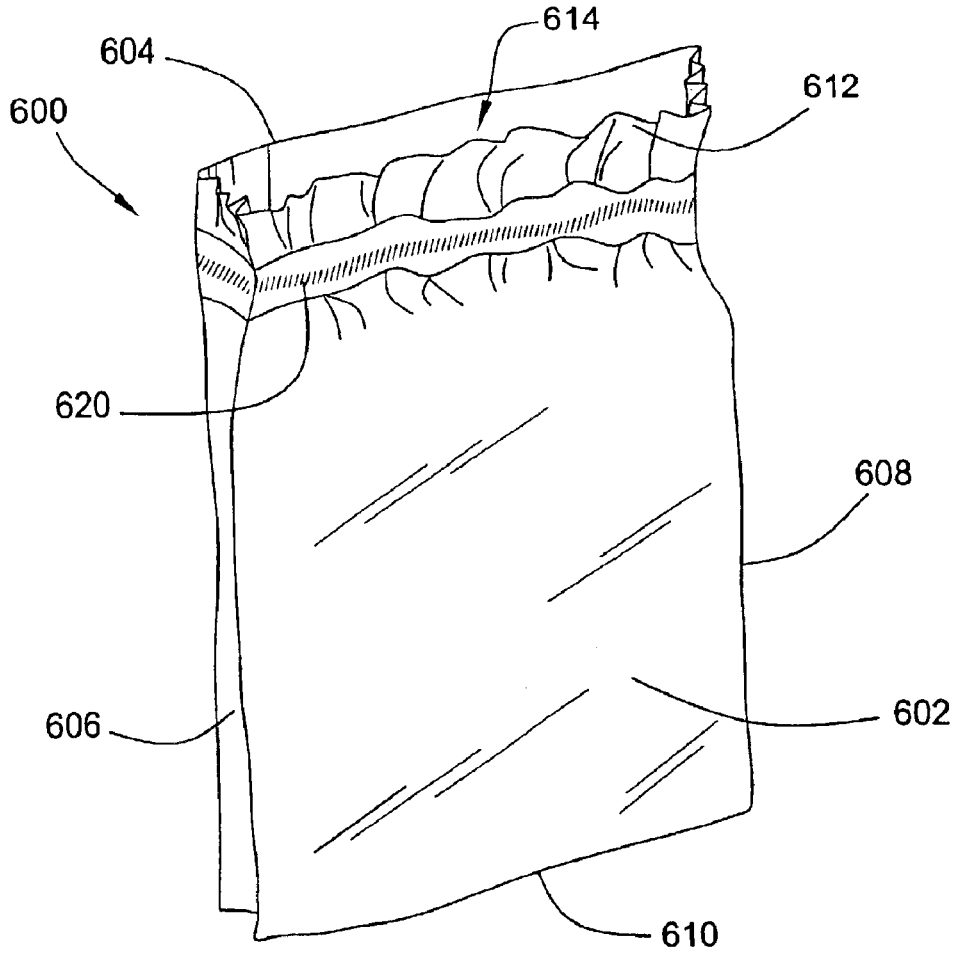
FIG. 12 is a perspective view of another embodiment of the present invention in the form of a gusseted plastic bag having an elastic strip mounted thereto.

Referring to FIG. 12, another embodiment of a bag 600 is shown. The bag 600 of FIG. 12 is a gusseted bag. The bag 600 includes first and second sidewalls 602, 604 that are joined together by a pair of common side gussets 606, 608. The bag 600 also includes a closed bottom end 610 and an open top end 612 defining an opening 614. There is attached across the first sidewall 602 adjacent to the open top end 612 an elastic strip 620. When the elastic strip is allowed to contract to its normal position, as illustrated in FIG. 12, the first sidewall 602 is bunched together giving the bag 600 a shirred appearance. To expand the opening 614 through the top end 612, the elastic strip 620 can be stretched along its longitudinal axis.

Figure 13:
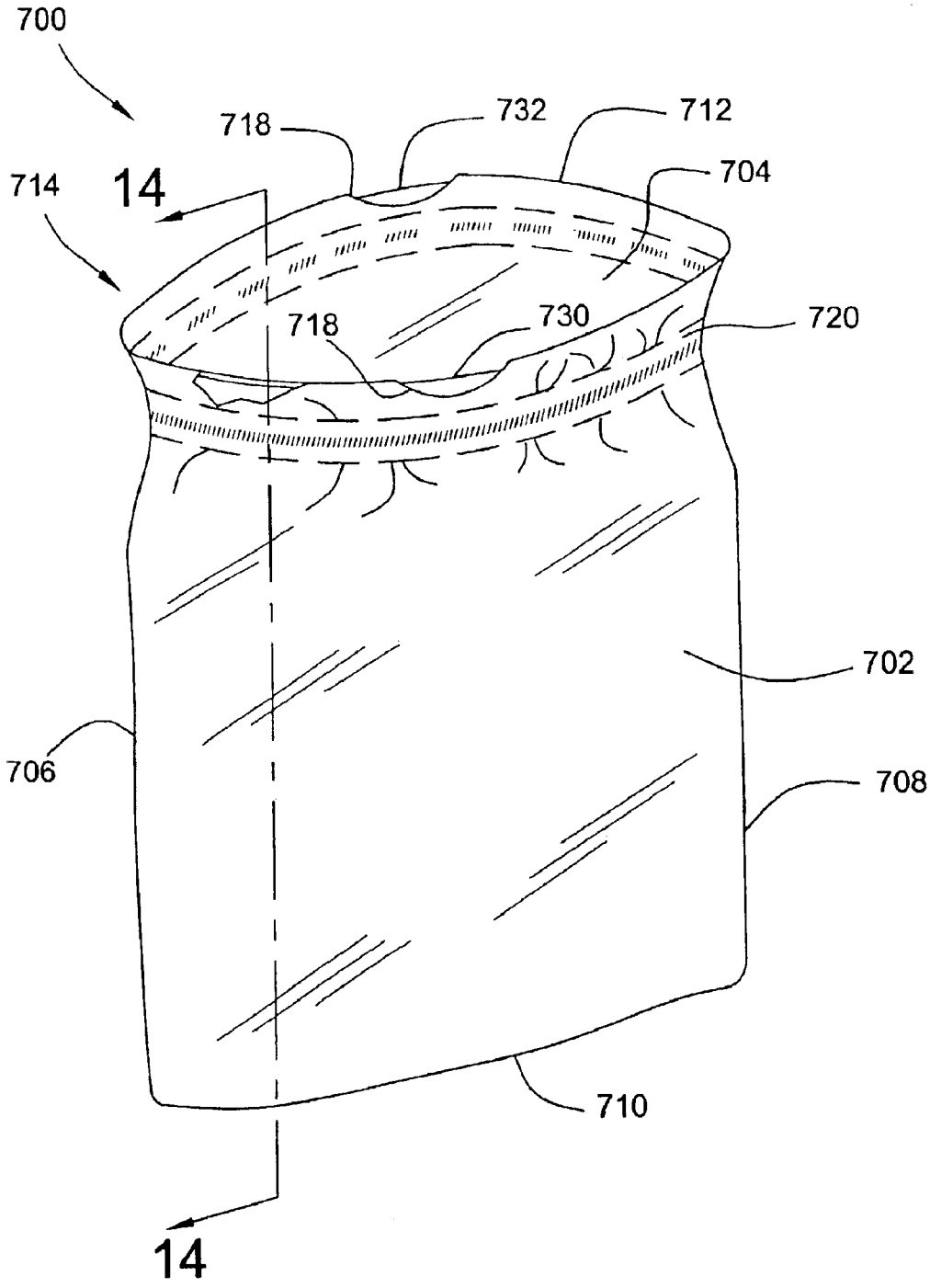
FIG. 13 is a perspective view of another embodiment of the present invention in the form of a draw tape plastic bag having an elastic strip mounted thereto.

Referring to FIG. 13, another embodiment of an elastic top bag 700 is illustrated. The bag 700 of FIG. 13 is a draw tape bag. The bag 700 includes first and second sidewalls 702, 704 that are joined by a common bottom end 710 and sealed side edges 706, 708. The bag includes a top end 712 having an opening 714 through which an interior volume of the bag can be accessed. There is attached across the first sidewall 702 adjacent to the open top end 712 an elastic strip 720. When the elastic strip 720 is allowed to contract to its normal position, as illustrated in FIG. 13, the first sidewall 702 is bunched together giving the bag 700 a shirred appearance. To expand the opening 714 through the top end 712, the elastic strip 720 can be stretched along its longitudinal axis. To substantially close the open top end 712, first and second draw tapes 730, 732 can be accessed through a plurality of notches 718 and operated to cinch the opening 714.

Figure 14:
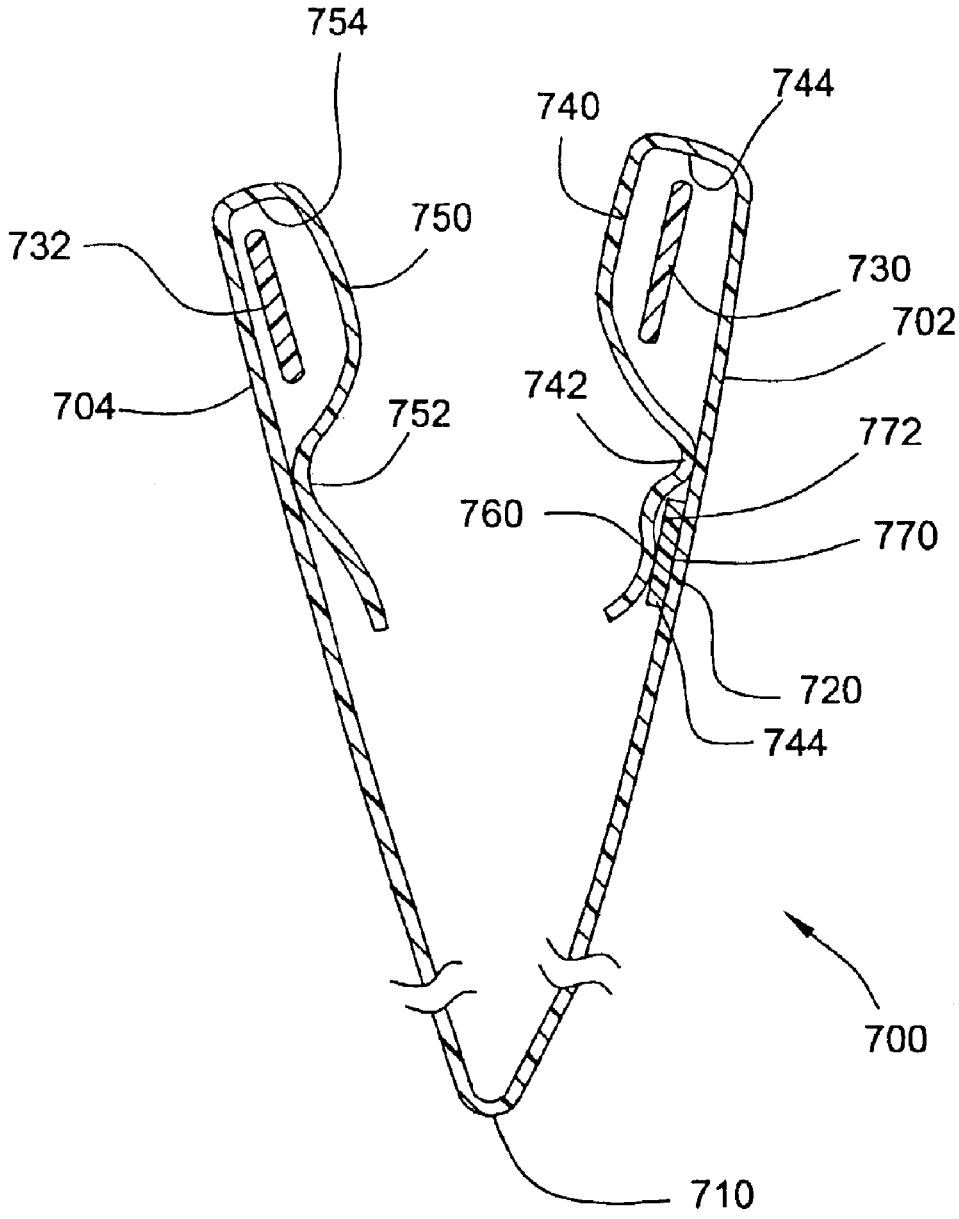
FIG. 14 is a cross-sectional view taken along line 14—14 in FIG. 13.

Referring to FIG. 14, for providing a channel in which the first draw tape 730 can pass, the first sidewall 702 includes a first hem-flap 740. The first hem-flap 740 is folded back inside the bag 700 and attached to the inside of the first sidewall 702 at a first hem-seal 742 to define a first hem 744. The first draw tape 730 is located within the first hem 744. The second draw tape 732 is located in a second hem 754 created by the second sidewall 704, a second hem-flap 750, and a second hem seal 752.

To attach the elastic strip 720 to the first sidewall 702, a third hem seal 760 can be formed between the first hem-flap 740 and the elastic strip 720 on the inside of the first sidewall 702. The third hem seal 760 continuously attaches approximately one-third 770 of the elastic strip 720 to the first sidewall 702 and first hem flap 740 while the remaining two thirds of the elastic strip 772, 774 are left unattached. Referring to FIG. 13, when allowed to contract to the normal position, the unattached portions 772, 774 can provide the bag 700 with a shirred appearance.

Thus, the present invention provides a plastic bag having a live elastic strip that can be quickly and inexpensively manufactured in large volumes. The live elastic strip can be continuously sealed across the width of the bag. The bag can be drawn over and gripped around the periphery of an object. The present invention also provides a method of processing such bags in large volumes by continuously sealing under tension live elastic tape across a web of material that is later divided into separate bags. The live elastic tape can be pre-stretched prior to its attachment to the web, both of which can be subsequently held in tension during the remaining processing steps.

All references, including publications, patent applications, and patents, cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) are to be construed to cover both the singular and the plural, unless otherwise indicated herein or clearly contradicted by context. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Of course, variations of those preferred embodiments would become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A bag comprising:

a first sidewall;

a second sidewall, the second sidewall joined to the first sidewall by a closed bottom end, a first edge, and a second edge, thereby defining an open top end;

a strip of live elastic material having a predefined width, a first discrete region along said width of the strip continuously attached in a pre-stretched expanded length condition to the first sidewall while a remaining region along said width of the strip remains unattached such that the open top end is pulled together when the elastic material is allowed to contract, the strip extending from the fast edge to the second edge and positioned a distance below the open top end.

2. The bag of claim 1, wherein the strip is attached by an attachment selected from the group consisting of adhesive, heat sealing, stitching, and a combination thereof.

3. The bag of claim 1, wherein the attached region has a first surface area, and the unattached region has a second surface area, the ratio of the first surface area to the second surface area being no greater than about 1.

4. The bag of claim 1, wherein the strip is proximate to and parallel with the open top end.

5. The bag of claim 1, further comprising:

a second strip of live elastic material attached to the second sidewall.

6. The bag of claim 1, wherein the attached region corresponds with a middle portion of the strip while the unattached region corresponds to first and second edge portions of the strip.

7. The bag of claim 1, wherein the bag comprises a type selected from the group consisting of a gusseted bag, a draw tape bag, and a tie-flap bag.

8. The bag of claim 1, wherein the bag comprises a gusseted bag, and the first and second sealed edges comprise a first and second gussets, respectively.

9. The bag of claim 1, the bag comprises a draw tape bag, wherein the first and second sidewalls each include a respective first and second hem flap, the first and second hem flaps being respectively attached to the first and second sidewalls at respective first and second hem seals thereby defining first and second hems, the bag further comprising a drawstring disposed within the first and second hems.

10. The bag of claim 1, the bag comprises a tie-flap bag wherein the first and second sidewalls include respective first and second tie-flaps or more extending from the top end.

11. A roll of bags comprising:

a plurality of bags, each bag including a first sidewall, a second sidewall joined to the first sidewall so as to define a closed bottom end, a first edge, a second edge, and an open top end;

the plurality of bags arranged to define a length with the first sealed edge of at least one bag joined to the second sealed edge of an adjacent bag;

a tape of live elastic material stretched lengthwise under tension to an expanded length, the tape having a predefined width;

a first discrete portion of the width of the tape continuously attached in its stretched expanded length condition to the length of the plurality of bags while a remaining portion along said width of the tape remains unattached;

wherein the length of the plurality of bags rolled together about an axis normal to the first and second edges of the attached tape, whereby the roll maintains the attached tape in the stretched condition.

12. The roll of claim 11, wherein the length is rolled about a core.

13. The roll of claim 11, wherein the joined first and second edges of the adjacent bags are perforated.

* * * * *